US009225123B2

(12) United States Patent
Ueda

(10) Patent No.: US 9,225,123 B2
(45) Date of Patent: Dec. 29, 2015

(54) USB RECEPTACLE

(71) Applicant: Japan Aviation Electronics Industry, Limited, Tokyo (JP)

(72) Inventor: Kouhei Ueda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/610,138

(22) Filed: Jan. 30, 2015

(65) Prior Publication Data

US 2015/0295364 A1 Oct. 15, 2015

(30) Foreign Application Priority Data

Apr. 11, 2014 (JP) ..... 2014-081544

(51) Int. Cl.
*H01R 13/6597* (2011.01)
*H01R 13/703* (2006.01)
*H01R 24/46* (2011.01)

(52) U.S. Cl.
CPC ..... *H01R 13/6597* (2013.01); *H01R 13/703* (2013.01); *H01R 24/46* (2013.01)

(58) Field of Classification Search
CPC ..... H01R 13/703; H01R 13/6597; H01R 2103/00; H01R 24/46
USPC ..... 439/188, 660, 607.34, 507, 315, 489, 439/490, 491, 374
See application file for complete search history.

(56) References Cited

U.S. PATENT DOCUMENTS

| | | | | |
|---|---|---|---|---|
| 7,850,471 | B2 | 12/2010 | Imai | |
| 8,574,011 | B2 * | 11/2013 | Shih | H01R 27/00 439/660 |
| 2007/0059959 | A1 * | 3/2007 | Chen | H01R 13/703 439/188 |
| 2010/0255702 | A1 * | 10/2010 | Lin | H01R 13/641 439/218 |
| 2014/0051274 | A1 * | 2/2014 | Yu | H01R 13/7031 439/188 |

FOREIGN PATENT DOCUMENTS

| | | | |
|---|---|---|---|
| CN | 202662862 | U | 1/2013 |
| JP | 2006-140167 | A | 6/2006 |
| JP | 2006-164669 | A | 6/2006 |
| JP | 2010-153341 | A | 7/2010 |
| JP | 3172188 | U | 11/2011 |
| JP | 2013-030452 | A | 2/2013 |

* cited by examiner

*Primary Examiner* — Abdullah Riyami
*Assistant Examiner* — Harshad Patel
(74) *Attorney, Agent, or Firm* — Collard & Roe, P.C.

(57) ABSTRACT

A USB receptacle mateable with a USB plug along a mating direction is disclosed. The USB receptacle comprises a holder member made of insulator, a shell made of conductor, and a detection pin made of conductor which is separated and is different from the shell. The detection pin is made of resiliently-deformable material and is held by the holder member so as not to be in direct contact with the shell. The detection pin includes a first contact portion and a second contact portion. The first contact portion and the second contact portion pinch a part of a plug shell of the USB plug when the USB receptacle is mated with the USB plug. Under a condition where the USB receptacle is not mated with the USB plug, the first contact portion and the second contact portion meet an inequality of "(b−a)<T", where "a" is a distance to the first contact portion from a center of the USB receptacle in the perpendicular direction perpendicular to the mating direction, "b" is a distance from the center to the second contact portion, and "T" is a thickness of a normal shell of a normal USB plug compliant with the USB standard.

9 Claims, 11 Drawing Sheets

USB RECEPTACLE

CROSS REFERENCE TO RELATED APPLICATIONS

An applicant claims priority under 35 U.S.C. §119 of Japanese Patent Application No. JP2014-81544 filed Apr. 11, 2014.

BACKGROUND OF THE INVENTION

This invention relates to a Universal Serial Bus (USB) receptacle with a detection pin.

As shown in FIGS. 21 and 22, JP 3172188 U discloses a USB receptacle 900 with a detection pin 940. As shown in FIG. 22, the USB receptacle 900 of JP 3172188 U comprises a plurality of contacts 910, a holder member 920 holding the contacts 910 and a shell 930 partially covering the holder member 920. The detection pin 940 is held by the holder member 920 on a right side of the USB receptacle 900 so as not to be in contact with the shell 930.

Under a state where the USB receptacle 900 of JP 3172188 U is mated with a USB plug (not shown), leftward movement of the USB plug weakens contact between the detection pin 940 and a plug shell of the USB plug (not shown). The detection pin 940 might go off the plug shell, depending upon movement amount of the USB plug.

Therefore, there is a need for a USB receptacle which can keep stable contact state between a detection pin and a plug shell even if a USB plug is moved in any direction.

SUMMARY OF THE INVENTION

One aspect of the present invention provides a Universal Serial Bus (USB) receptacle mateable with a USB plug along a mating direction. The USB plug includes a plug shell. The USB receptacle comprises a plurality of contacts, a holder member made of insulator, a shell made of conductor, and a detection pin made of conductor which is separated and is different from the shell. The holder member holds the contacts and arranges the contacts in a pitch direction perpendicular to the mating direction. The shell surrounds, at least in part, the holder member in a plane which is perpendicular to the mating direction. The detection pin is made of resiliently-deformable material and is held by the holder member so as not to be in direct contact with the shell. The detection pin includes a first support portion, a second support portion, a first contact portion and a second contact portion. The first support portion supports the first contact portion. The second support portion is positioned outside of the first support portion in a perpendicular direction perpendicular to the mating direction and supports the second contact portion. Each of the first contact portion and the second contact portion is movable in a predetermined plane defined by the mating direction and the perpendicular direction. The first contact portion and the second contact portion pinch a part of the plug shell when the USB receptacle is mated with the USB plug. Under a condition where the USB receptacle is not mated with the USB plug, the first contact portion and the second contact portion meet an inequality of "$(b-a)<T$", where "a" is a distance to the first contact portion from a center of the USB receptacle in the perpendicular direction, "b" is a distance from the center to the second contact portion, and "T" is a thickness of a normal shell of a normal USB plug compliant with the USB standard.

Since the first contact portion and the second contact portion are designed to pinch a part of the plug shell, at least one of the first contact portion and the second contact portion is in contact with the plug shell even if the USB plug is moved in any direction. Thus, stable contact state between the detection pin and the plug shell can be kept so that insertion of the USB plug can be detected suitably.

If the first contact portion and the second contact portion are arranged at positions which the normal shell of the normal USB plug cannot reach but which the custom shell of the custom USB plug can reach, it can be judged whether the custom USB plug or the normal USB plug is inserted.

An appreciation of the objectives of the present invention and a more complete understanding of its structure may be had by studying the following description of the preferred embodiment and by referring to the accompanying drawings.

Figure 1:
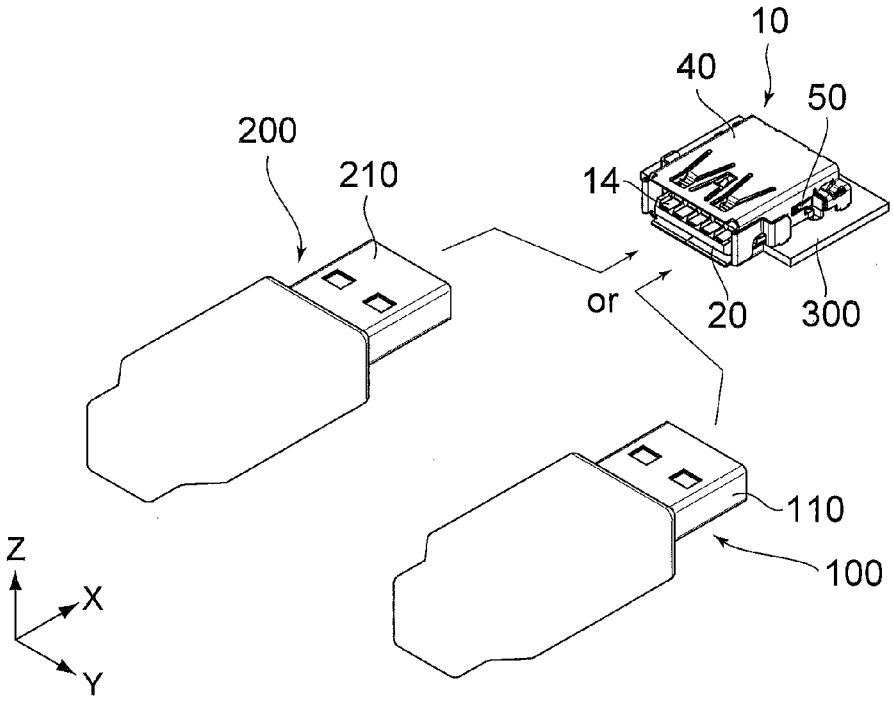
FIG. 1 is a perspective view showing a USB receptacle, a normal USB plug and a custom USB plug (USB plug) according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

With reference to FIG. 1, a Universal Serial Bus (USB) receptacle 10 according to an embodiment of the present invention is to be fixed to a board 300 and is selectively mateable with one of a normal USB plug 100 and a custom USB plug (USB plug) 200 along a mating direction (X-direction). Note here that the normal USB plug 100 is compliant with the USB standard, while the custom USB plug 200 is different from the normal USB plug 100. Specifically, as shown in FIG. 1, the USB receptacle 10 of the present embodiment is of a so-called drop-in type which is arranged within a recessed portion formed in the board 300. However, the present invention is not limited thereto. For example, the USB receptacle may be mounted and fixed on a principal plane of the board 300.

Figure 2:
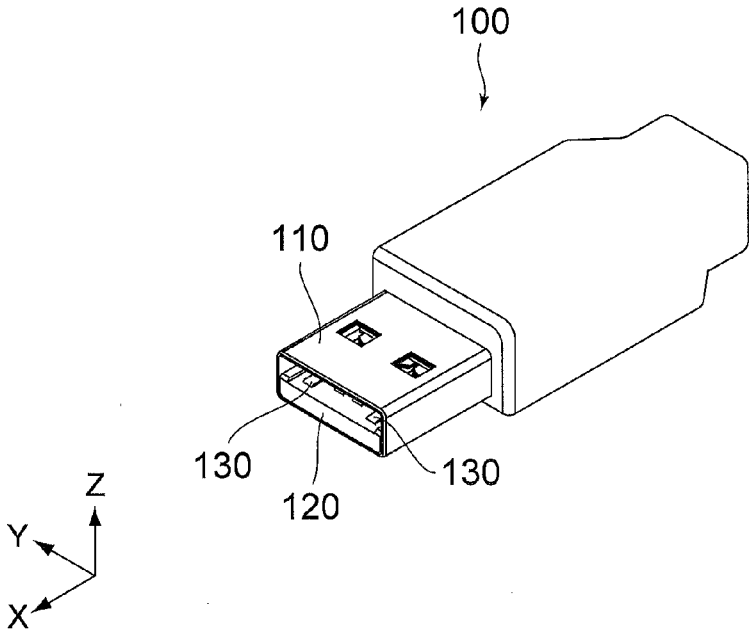
FIG. 2 is a perspective view showing the normal USB plug of FIG. 1.
Figure 3:
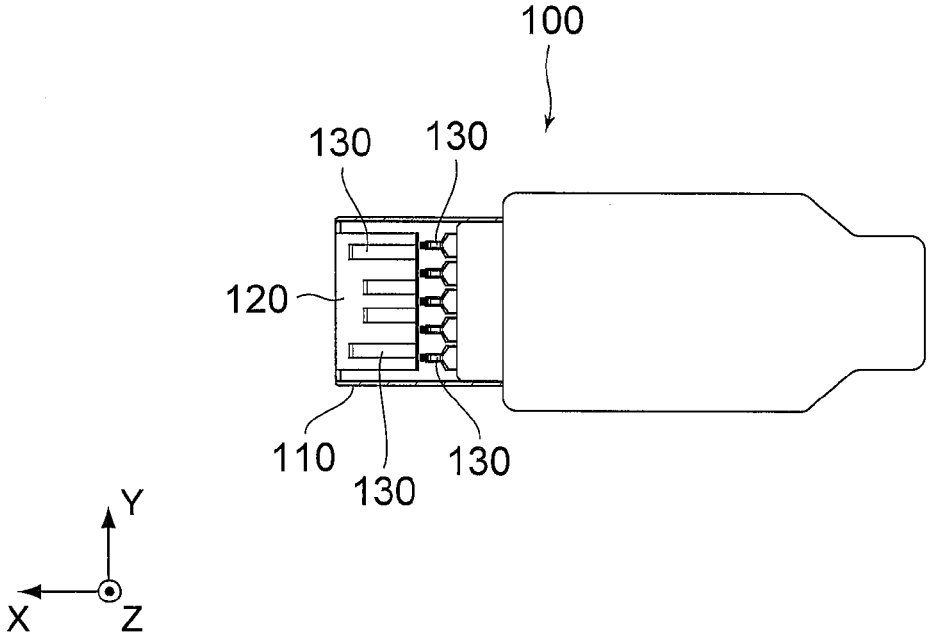
FIG. 3 is a top plan view showing the normal USB plug of FIG. 2, which is partially cut away.

As shown in FIGS. 2 and 3, the normal USB plug 100 comprises a normal shell 110 compliant with the USB standard, a plug insulator 120 and plug contacts 130. The normal shell 110 is formed by bending a metal plate that has a predefined thickness. The normal shell 110 covers the plug insulator 120. The plug insulator 120 is a plate-like insulator and holds the plug contacts 130. As understood from FIGS. 2 and 3, an end face of the normal shell 110 is substantially flush with an end face of the plug insulator 120.

Figure 4:
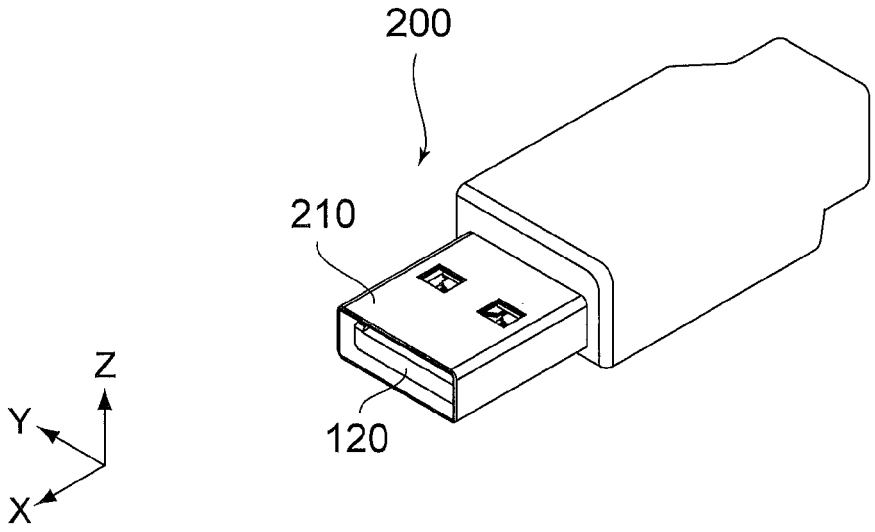
FIG. 4 is a perspective view showing the custom USB plug of FIG. 1.
Figure 5:
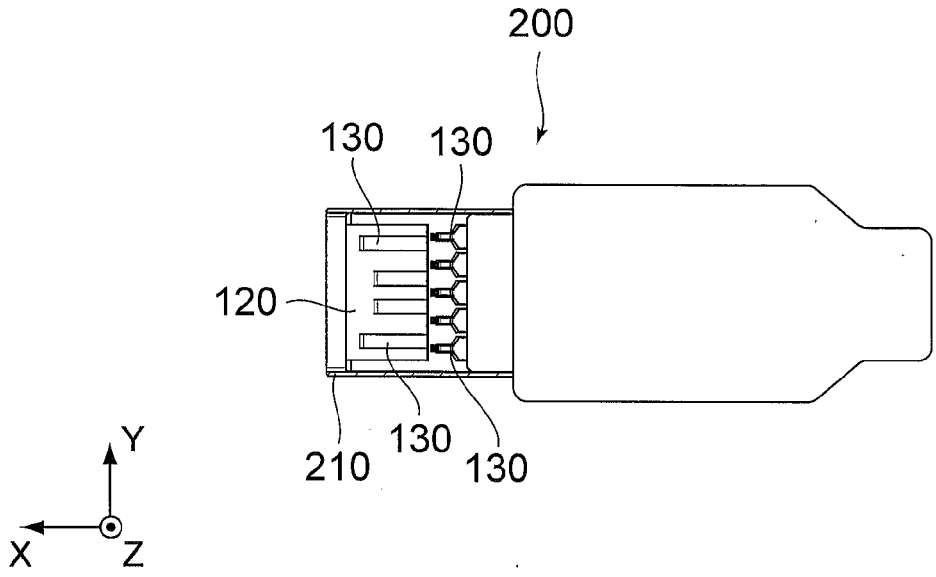
FIG. 5 is a top plan view showing the custom USB plug of FIG. 4, which is partially cut away.

As understood from FIGS. 4 and 5, the custom USB plug 200 comprises a custom shell (plug shell) 210, the plug insulator 120 and the plug contacts 130, wherein the custom shell 210 is made of material same as that of the normal shell 110 but is different in shape from the normal shell 110. In other words, the custom USB plug 200 has a structure same as that of the normal USB plug 100 except for the custom shell 210. The custom shell 210 is longer than the normal shell 110 in the mating direction. Accordingly, the end face of the plug insulator 120 is located on a far side, or a negative X-side, in the mating direction in comparison with an end face of the custom shell 210.

Figure 6:
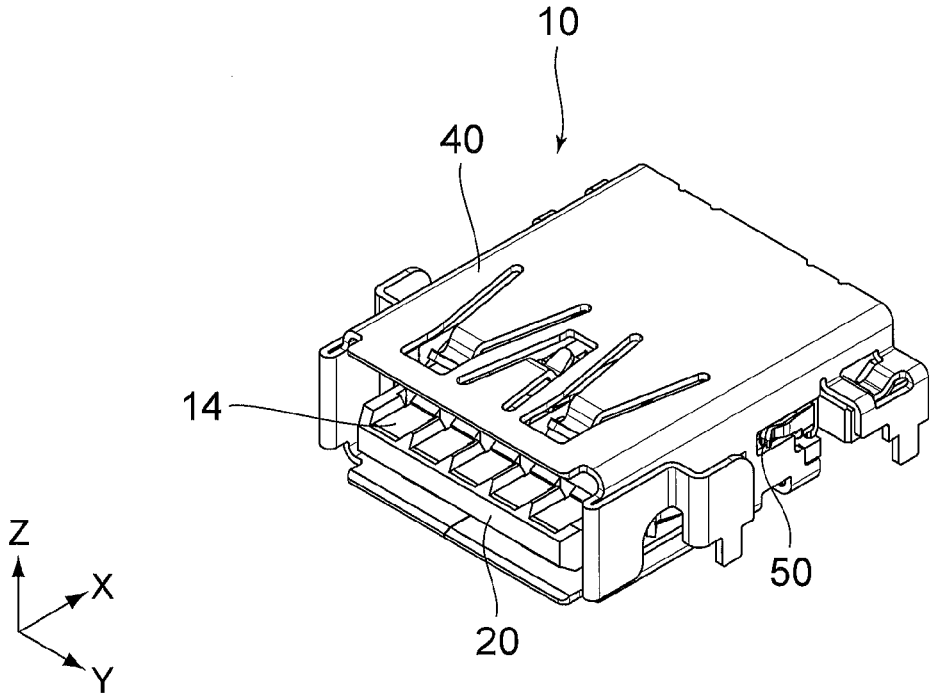
FIG. 6 is a perspective view showing the USB receptacle of FIG. 1.
Figure 11:
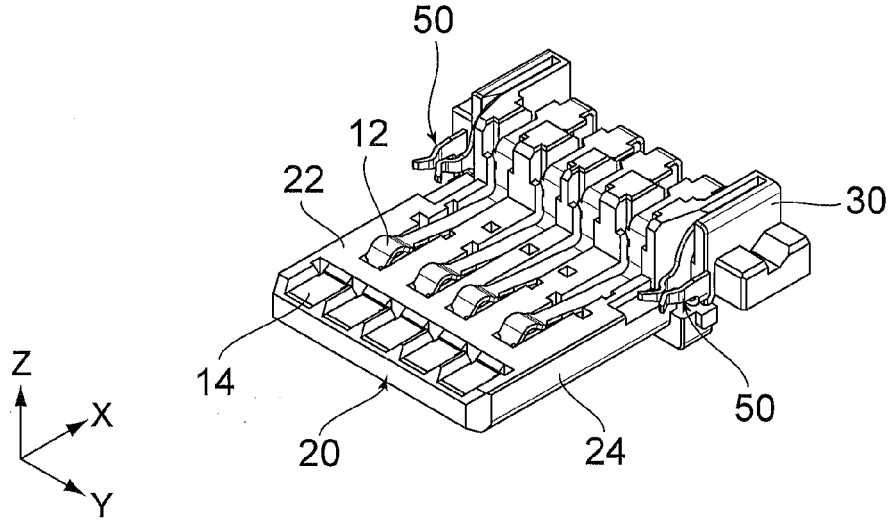
FIG. 11 is a perspective view showing a structure that is of the USB receptacle of FIG. 6 but except for a shell.
Figure 12:
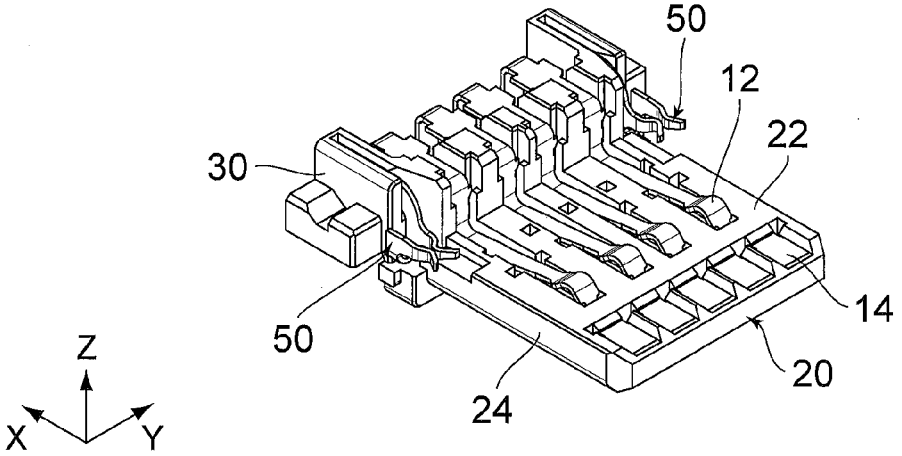
FIG. 12 is another perspective view showing the structure of FIG. 11.

As understood from FIGS. 6, 11 and 12, the USB receptacle 10 comprises a plurality of contacts 12 each made of conductor, a plurality of contacts 14 each made of conductor, a holder member 20 made of insulator, a shell 40 made of conductor and two detection pins 50 each made of conductor, which are separated and are different from the shell 40.

As shown in FIGS. 7 and 11 to 13, the contacts 12 are for USB 2.0 and are four in number. The contacts 14 are for USB 3.0 and are five in number.

Figure 13:
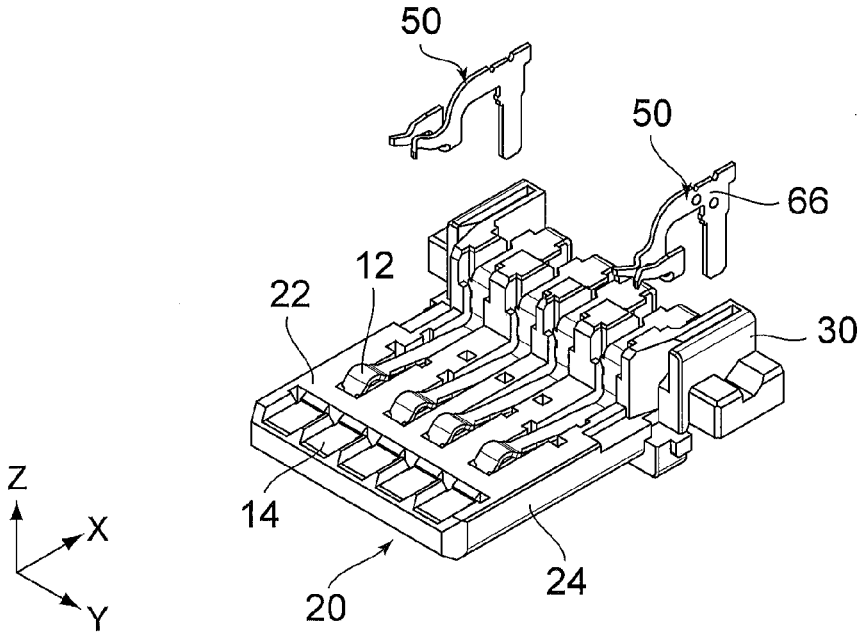
FIG. 13 is still another perspective view showing the structure of FIG. 11, wherein a detection pin is not held by a holder member yet.

As shown in FIGS. 11 to 13, the holder member 20 includes a front portion 22 of a plate-like shape and a rear portion 30 of a block-like shape. The holder member 20 holds the contacts 12, 14 and arranges the contacts 12, 14 in a pitch direction (Y-direction) perpendicular to the mating direction. In detail, the contacts 12 are press-fit in and held by the rear portion 30. The contacts 14 are embedded in the holder member 20 through an insert-molding method upon molding of the holder member 20. As understood from FIGS. 8 to 10, opposite side surfaces of the front portion 22 in the pitch direction serve as inner guide portions 24, respectively, which guide insertion of the normal shell 110 (see FIG. 3) or the custom shell 210 (see FIG. 5). In other words, the holder member 20 of the present embodiment is provided with the inner guide portions 24.

Figure 7:
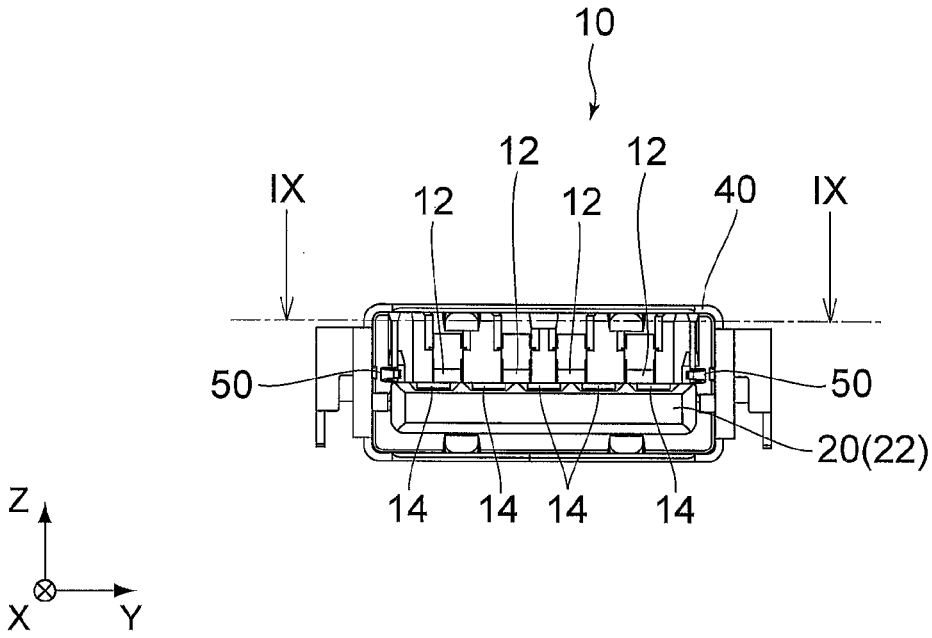
FIG. 7 is a front view showing the USB receptacle of FIG. 6.
Figure 9:
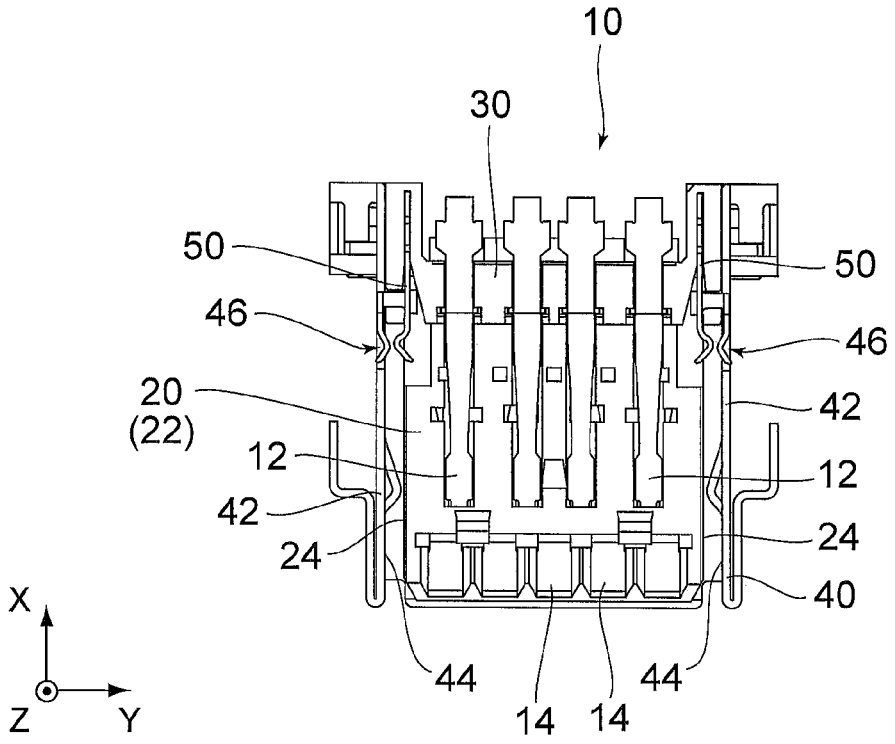
FIG. 9 is a cross-sectional view showing the USB receptacle of FIG. 7, taken along line IX-IX.
Figure 10:
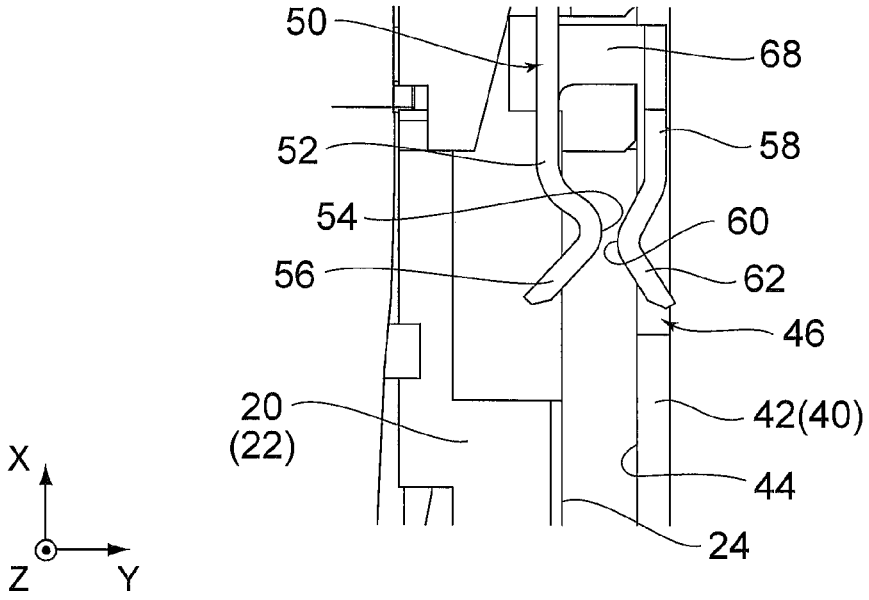
FIG. 10 is an enlarged view showing a part of the USB receptacle of FIG. 9.

As shown in FIGS. 6 and 7, the shell 40 surrounds, at least in part, the holder member 20 in a plane (YZ plane) perpendicular to the mating direction. As understood from FIGS. 8 to 10, inside surfaces of opposite side portions 42 of the shell 40 of the present embodiment serve as outer guide portions 44, respectively, which guide insertion of the normal shell 110 (see FIG. 3) or the custom shell 210 (see FIG. 5). The outer guide portions 44 of the present embodiment are positioned outwards of the inner guide portions 24 in a perpendicular direction perpendicular to the mating direction. As understood from FIGS. 8 to 10, the perpendicular direction is the pitch direction, or a Y-direction, in the present embodiment. As shown in FIGS. 9 and 10, the side portions 42 of the shell 40 are formed with openings 46, respectively.

Each of the detection pins 50 of the present embodiment is made of resiliently-deformable material. Specifically, each of the detection pins 50 is made of metal. As shown in FIGS. 9 and 10, the detection pins 50 are held by the holder member 20 so as not to be in direct contact with the shell 40. As shown in FIG. 9, the two detection pins 50 are positioned on the far side in the mating direction and opposite sides in the pitch direction of the USB receptacle 10.

As understood from FIGS. 11 to 13, the two detection pins 50 have structures as mirror images of each other. As shown in FIG. 9, the detection pins 50 are arranged symmetrically to each other with respect to a plane which passes a center of the USB receptacle 10 in the pitch direction and which is perpendicular to the pitch direction.

Figure 14:
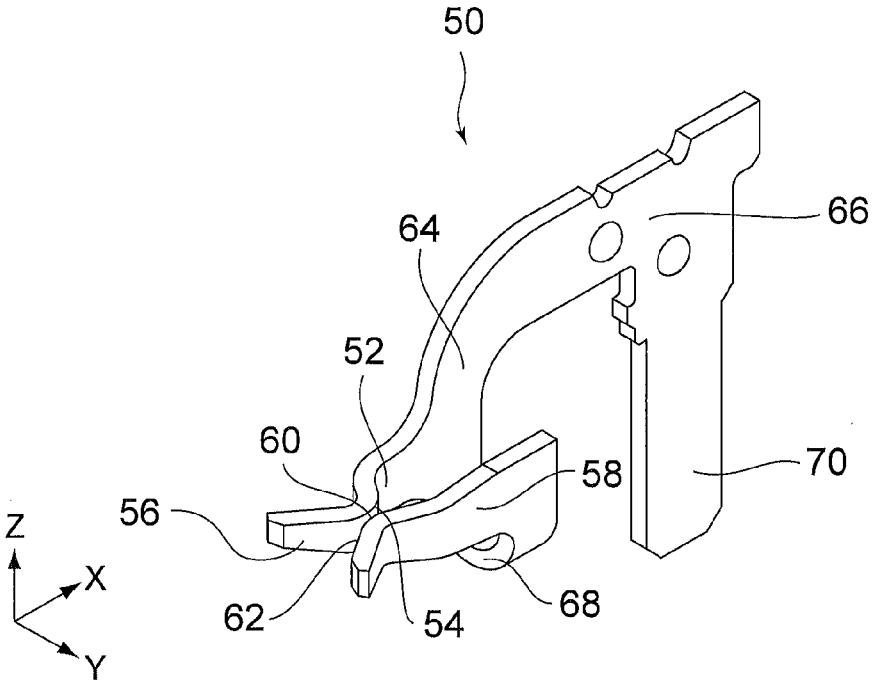
FIG. 14 is a perspective view showing the detection pin of FIG. 13.

FIG. 14 shows a right one of the detection pins 50, or a positive Y-side detection pin 50. As shown in FIG. 14, the detection pin 50 includes a first support portion 52, a first contact portion 54, a first guide portion 56, a second support portion 58, a second contact portion 60, a second guide portion 62, a base portion 64, a coupling portion 68 and a connection portion 70. A left one of the detection pins 50, or a negative Y-side detection pin 50, has a structure as a mirror image of the detection pin 50 of FIG. 14. In other words, the left detection pin 50 and the right detection pin 50 have structures symmetrical to each other with respect to an XZ plane.

Figure 16:
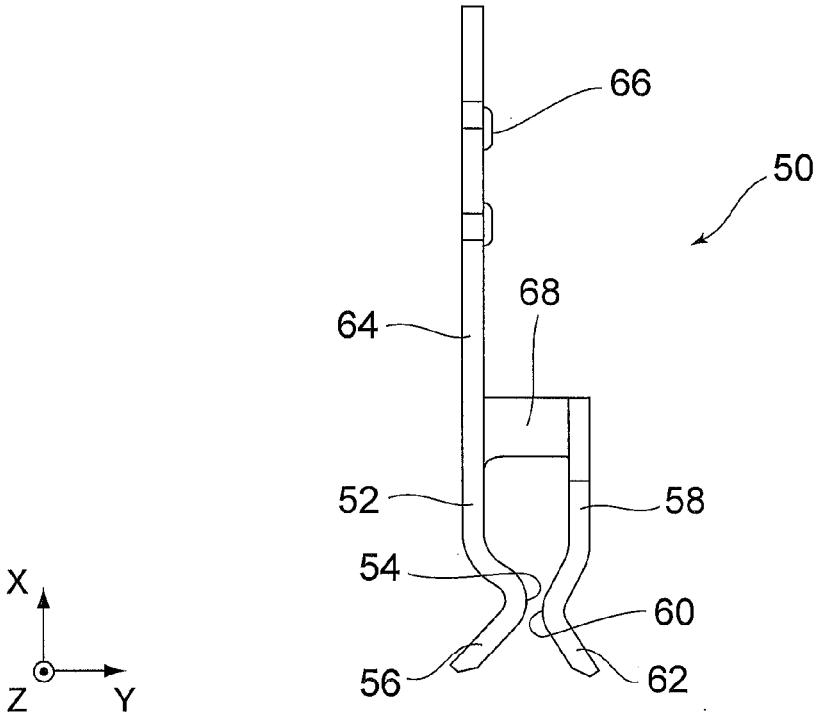
FIG. 16 is a top plan view showing the detection pin of FIG. 14.

As shown in FIGS. 14 and 16, the first support portion 52 has a short arm-like shape and supports the first contact portion 54. Likewise, the second support portion 58 has a short arm-like shape and supports the second contact portion 60. The second support portion 58 of the present embodiment is positioned outside of the first support portion 52 in a perpendicular direction perpendicular to the mating direction. As apparent from FIG. 10, the perpendicular direction is the pitch direction, or the Y-direction, in the present embodiment.

Figure 8:
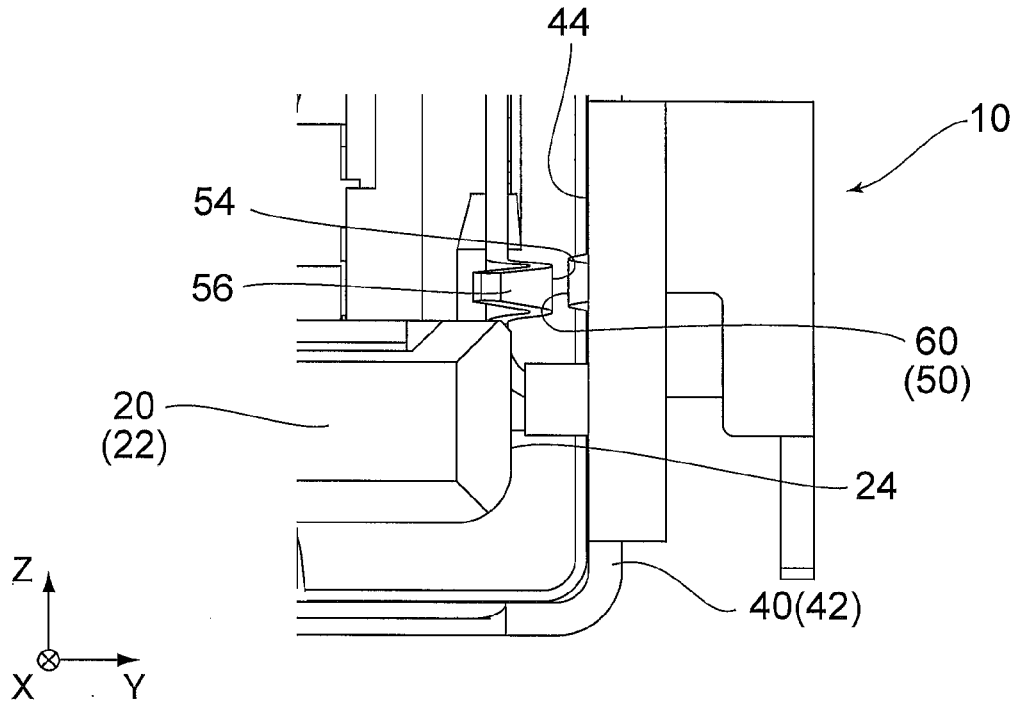
FIG. 8 is an enlarged view showing a part of the USB receptacle of FIG. 7.
Figure 15:
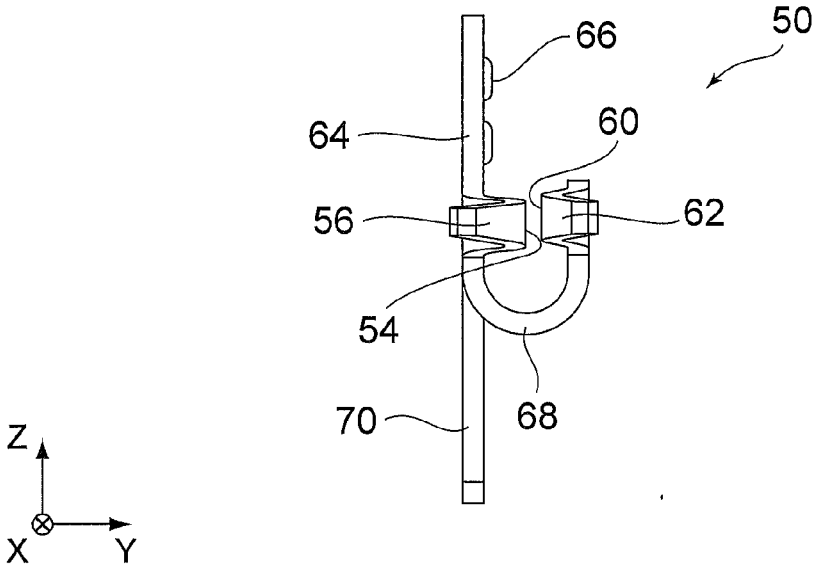
FIG. 15 is a front view showing the detection pin of FIG. 14.

As shown in FIGS. 8 and 10, the first contact portion 54 of the present embodiment is positioned inside of the second contact portion 60 in the pitch direction. In other words, as shown in FIGS. 14 to 16, a section from the first support portion 52 to the first contact portion 54 does not intersect another section from the second support portion 58 to the second contact portion 60. As shown in FIGS. 8 and 15, the first contact portion 54 and the second contact portion 60 face each other in the pitch direction. In particular, as understood from FIG. 10, the first contact portion 54 and the second contact portion 60 are located within the shell 40 under an unmated state where the USB receptacle 10 is not mated with the custom USB plug 200.

As understood from FIGS. 14 and 16, the base portion 64 extends from the first support portion 52. The base portion 64 is provided with a held portion 66 which is held by the holder member 20 (see FIG. 11). The base portion 64 and the first support portion 52 serve together as a first spring portion which starts with the held portion 66 and is resiliently-deformable. In other words, the first contact portion 54 is supported by the first spring portion including the first support portion 52.

As shown in FIGS. 14 and 16, the coupling portion 68 couples the first support portion 52 and the second support portion 58 with each other. In detail, as understood from FIG. 15, the coupling portion 68 has a cross-section of U-shape like in a plane (YZ plane) perpendicular to the mating direction. As shown in FIG. 16, the coupling portion 68 couples an one end, or the positive X-side end, of the second support portion 58 with a boundary between the first support portion 52 and the base portion 64, or the positive X-side end of the first support portion 52. The coupling portion 68 and the second support portion 58 serve together as a second spring portion which is resiliently deformable. In other words, the second contact portion 60 is supported by the second spring portion including the second support portion 58.

As shown in FIGS. 14 and 15, the connection portion 70 extends from the base portion 64. The connection portion 70 is a portion which is inserted in a hole (not shown) of the board 300 and soldered on the board 300 under a state where the USB receptacle 10 is fixed to the board 300.

Because of the aforementioned functions of the first spring portion, i.e. the first support portion 52 and the base portion 64, and the second spring portion, i.e. the second support portion 58 and the coupling portion 68, each of the first contact portion 54 and the second contact portion 60 is movable in a predetermined plane (XY plane) which is defined by the mating direction and the pitch direction. Note here that movements of the second contact portions 60 in the predetermined plane are not restricted since the side portions 42 of the shell 40 are formed with openings 46, respectively, as mentioned above (see FIG. 10). In other words, the openings 46 allow the movements of the second contact portions 60 in the predetermined plane.

In particular, as understood from FIG. 14, the second spring portion, i.e. the second support portion 58 and the coupling portion 68, extends from a middle of the first spring portion, i.e. the first support portion 52 and the base portion 64, in the present embodiment. Accordingly, the movement of the second contact portion 60 has an influence on the movement of the first contact portion 54 through the second spring portion and the first spring portion, while the movement of the first contact portion 54 has an influence on the movement of the second contact portion 60 through the first spring portion and the second spring portion.

Figure 17:
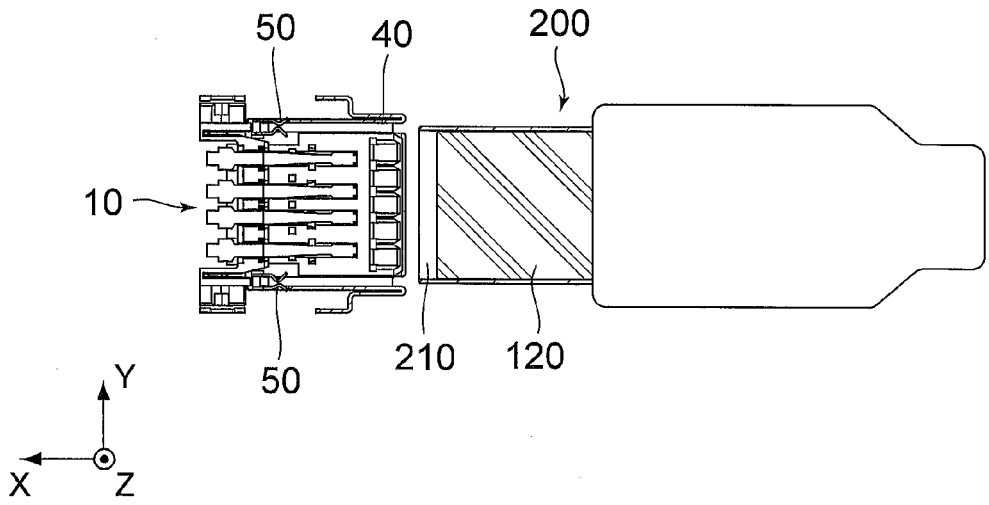
FIG. 17 is a cross-sectional view showing the USB receptacle and the custom USB plug of FIG. 1, wherein the USB receptacle and the custom USB plug are in an unmated state.
Figure 18:
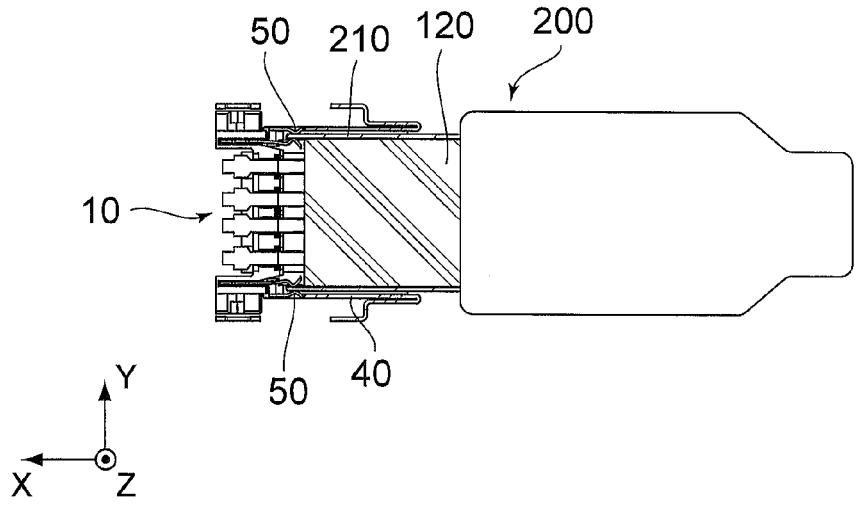
FIG. 18 is a cross-sectional view showing the USB receptacle and the custom USB plug of FIG. 1, wherein the USB receptacle and the custom USB plug are in a mated state.
Figure 19:
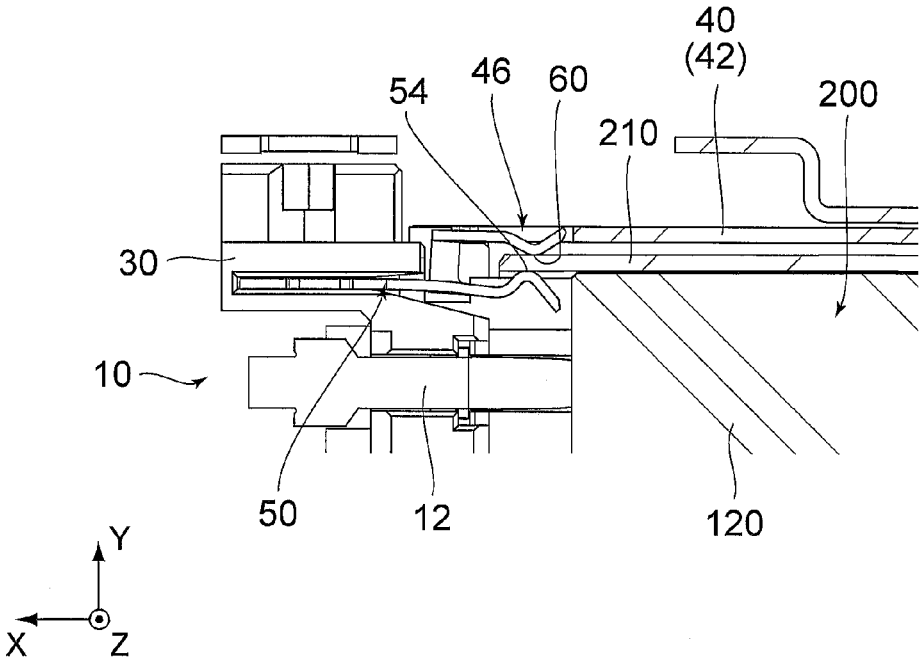
FIG. 19 is an enlarged view showing a part of the USB receptacle and a part of the custom USB plug of FIG. 18.

As understood from FIGS. 17 to 19, the first contact portion 54 and the second contact portion 60 pinch a part of the custom shell 210 when the USB receptacle 10 is mated with the custom USB plug 200. Therefore, a distance between the first contact portion 54 and the second contact portion 60 in the pitch direction is shorter than a plate thickness (or, simply, thickness) T of the normal shell 110 (see FIG. 3). In other words, under a condition where the USB receptacle 10 is not mated with the custom USB plug 200, the first contact portion 54 and the second contact portion 60 meet an inequality of "$(b-a)<T$", where "a" is a distance to the first contact portion 54 from a center of the USB receptacle 10 in the pitch direction, and "b" is a distance from the center to the second contact portion 60. Since the first contact portion 54 of the present embodiment is located inside of the second contact portion 60 in the pitch direction as described above, the difference (b-a) is always positive. However, the present invention is not limited thereto. For example, the first contact portion 54 may be located outside of the second contact portion 60 in the pitch direction, provided that the first contact portion 54 and the second contact portion 60 can pinch a part of the custom shell 210 when the USB receptacle 10 is mated with the custom USB plug 200. In other words, a section from the first support portion 52 to the first contact portion 54 may intersect another section from the second support portion 58 to the second contact portion 60. In the intersecting case, the difference (b−a) in the aforementioned inequality has a negative value. Since the thickness T always has a positive value, the inequality $(b-a)<T$ is met absolutely even if the difference (b−a) has a negative value. In addition, the first contact portion 54 may be in contact with the second contact portion 60 before insertion of the custom shell 210, provided that the first contact portion 54 and the second contact portion 60 can pinch a part of the custom shell 210 when the USB receptacle 10 is mated with the custom USB plug 200. In other words, the difference (b−a) in the aforementioned inequality may be zero. Also, in the contact case, since the thickness T always has a positive value, the aforementioned inequality $(b-a)<T$ is met absolutely.

In particular, as seen from that the plug insulator 120 does not reach the first contact portion 54 and the second contact portion 60 in FIG. 19, the first contact portion 54 and the second contact portion 60 of the present embodiment are arranged at positions which the normal shell 110 (see FIGS. 2 and 3) does not reach when the USB receptacle 10 is mated with the normal USB plug 100 (see FIGS. 2 and 3) but which the custom shell 210 (see FIG. 19) reaches when the USB receptacle 10 is mated with the custom USB plug 200 (see FIG. 19). Thus, the custom shell 210 can be in contact with the first contact portion 54 and the second contact portion 60, whereas the normal shell 110 cannot be in contact with the first contact portion 54 and the second contact portion 60. Therefore, it can be detected by using the detection pin 50 whether an inserted plug is the normal USB plug 100 or the custom USB plug 200.

Figure 20:
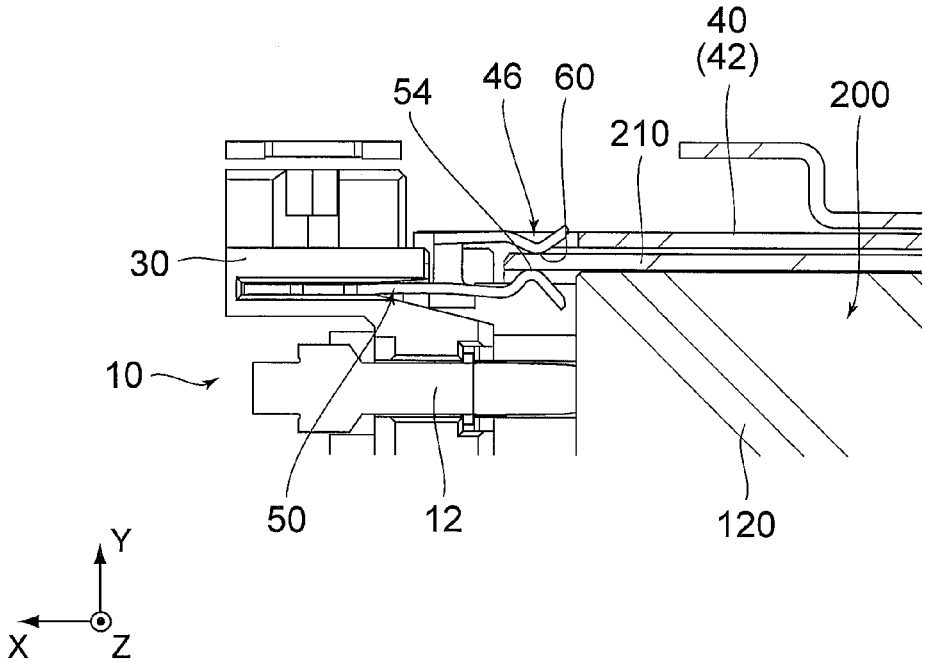
FIG. 20 is another enlarged view showing a part of the USB receptacle and a part of the custom USB plug of FIG. 18, wherein the illustrated custom USB plug is moved towards a positive Y-side.
Figure 21:
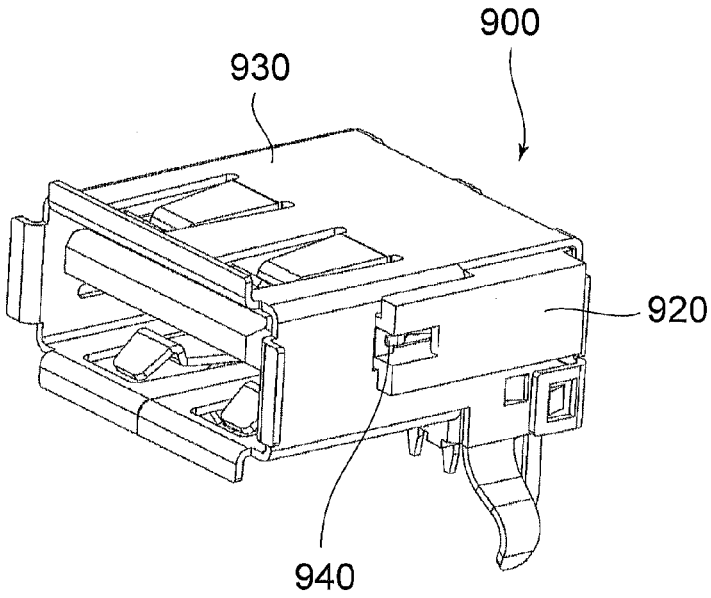
FIG. 21 PRIOR ART
FIG. 21 is a perspective view showing a USB receptacle of JP 3172188 U.
Figure 22:
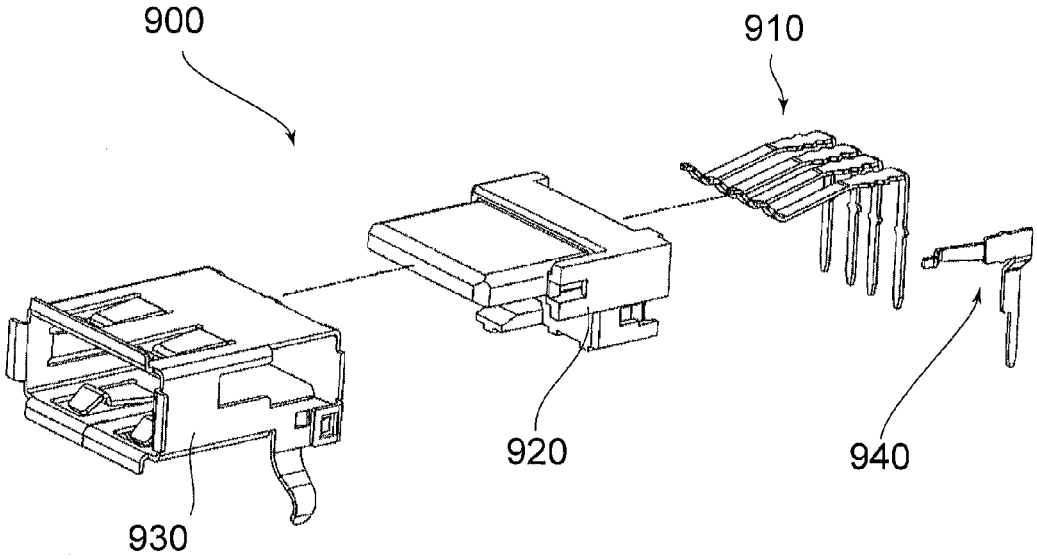
FIG. 22 PRIOR ART
FIG. 22 is an exploded, perspective view showing the USB receptacle of FIG. 21.

Since the first contact portion 54 and the second contact portion 60 are designed to pinch a part of the custom shell 210, at least one of the first contact portion 54 and the second contact portion 60 is surely in contact with the custom shell 210 even if the custom USB plug 200 is moved in one orientation in the pitch direction, as shown in FIG. 20. Therefore, the present embodiment can ensure contact reliability of the custom shell 210 on the detection pin 50.

In the present embodiment, the movement of the first contact portion 54 has an influence on the movement of the second contact portion 60 through the first spring portion and the second spring portion, while the movement of the second contact portion 60 has an influence on the movement of the first contact portion 54 through the second spring portion and the first spring portion. Therefore, both the first contact portion 54 and the second contact portion 60 can follow the movement of the custom shell 210 when the custom USB plug 200 is moved in one orientation in the pitch direction, as shown in FIG. 20. Therefore, the present embodiment can ensure higher contact reliability.

As shown in FIG. 16, the first guide portion 56 extends from the first contact portion 54 and intersects the mating direction. Likewise, the second guide portion 62 extends from the second contact portion 60 and intersects the mating direction. As understood from FIGS. 8 and 10, an end of the first guide portion 56 is located inside of the inner guide portion 24 in the perpendicular direction. The first contact portion 54 and the second contact portion 60 are positioned between the outer guide portion 44 and the inner guide portion. As understood from FIG. 10, an end of the second guide portion 62 is located outside of the outer guide portion 44 in the perpendicular direction. The thus-arranged first and second guide portions 56, 62 can prevent the custom shell 210 from buckling the detection pins 50 upon the mating of the custom USB plug 200 with the USB receptacle 10 (see FIG. 19).

Although the custom shell 210 of the present embodiment is designed to be longer, as a whole, than the normal shell 110, the present invention is not limited thereto. The custom shell 210 may be modified, provided that the custom shell 210 includes a portion which is pinched by the first contact portion 54 and the second contact portion 60. In other words, the custom shell 210 is sufficient if it is, at least in part, longer than the normal shell 110 in the mating direction.

Although the perpendicular direction is the pitch direction in the above-described embodiment, the present invention is not limited thereto. For example, the perpendicular direction may be a direction which is perpendicular to the mating direction but is other than the pitch direction, such as a predetermined direction (Z-direction) which is perpendicular both to the mating direction and the pitch direction.

Although the USB receptacle 10 of the above-described embodiment is provided with the two detection pins 50, the present invention is not limited thereto. The USB receptacle 10 may be provided with only one detection pin 50.

Although the coupling portion 68 couples the second support portion 58 to a middle of the first spring portion, i.e. the first support portion 52 and the base portion 64, in the above-described embodiment, the present invention is not limited thereto. For example, the coupling portion 68 may couple an end, or the positive X-side end, of the first spring portion with an end, or the positive X-side end, of the second spring portion which consists of the second support portion 58 only. However, in order to synchronize the movement of the first contact portion 54 with the movement of the second contact portion 60, it is desirable that the second spring portion extends from a middle of the first spring portion. Thus, it is desirable that the coupling portion 68 couples the second support portion 58 to a middle of the first spring portion.

Although the first support portion 52 and the second support portion 58 are coupled by the coupling portion 68 in the above-described embodiment, the present invention is not limited thereto. The first support portion 52 and the second support portion 58 are formed as parts of members, respectively, which are different from each other. In that case, the first support portion 52 and the second support portion 58 are at least required to be electrically connected to each other on the board 300 on which the USB receptacle 10 is mounted.

Although the two detection pins 50 are used to detect insertion of only one kind of the custom USB plug 200 in the above-described embodiment, the present invention is not limited thereto. For example, the two detection pins 50 may be used independently from each other so as to detect insertion of three kinds of the custom shells 210 having different shapes from each other.

Although the USB plug is the custom USB plug 200 in the above-described embodiment, the USB plug may be both the normal USB plug 100 and the custom USB plug 200. In other words, the detection pins 50 may be used to detect insertion any one of the normal USB plug 100 and the custom USB plug 200 into the USB receptacle 10.

Although the USB receptacle 10 is selectively mateable with one of the normal USB plug 100 and the custom USB plug 200, the USB receptacle 10 may be mateable with the normal USB plug 100 alone. In that case, the USB plug is the normal USB plug 100 alone. In other words, the first contact portion 54 and the second contact portion 60 are arranged to be contactable to the normal shell 110 as the plug shell, while the detection pins 50 are used to detect insertion of the normal USB plug 100.

The present application is based on a Japanese patent application of JP2014-81544 filed before the Japan Patent Office on Apr. 11, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A Universal Serial Bus (USB) receptacle mateable with a USB plug along a mating direction, the USB plug including a plug shell, wherein:

the USB receptacle comprises a plurality of contacts, a holder member made of insulator, a shell made of conductor, and a detection pin made of conductor which is separated and is different from the shell;

the holder member holds the contacts and arrange the contacts in a pitch direction perpendicular to the mating direction;

the shell surrounds, at least in part, the holder member in a plane perpendicular to the mating direction;

the detection pin is made of resiliently-deformable material and is held by the holder member so as not to be in direct contact with the shell;

the detection pin includes a first support portion, a second support portion, a first contact portion and a second contact portion;

the first support portion supports the first contact portion;

the second support portion is positioned outside of the first support portion in a perpendicular direction perpendicular to the mating direction and supports the second contact portion;

each of the first contact portion and the second contact portion is movable in a predetermined plane defined by the mating direction and the perpendicular direction;

the first contact portion and the second contact portion pinch a part of the plug shell when the USB receptacle is mated with the USB plug; and under a condition where the USB receptacle is not mated with the USB plug, the first contact portion and the second contact portion meet an inequality of "$(b-a)<T$", where "a" is a distance to the first contact portion from a center of the USB receptacle in the perpendicular direction, "b" is a distance from the center to the second contact portion, and "T" is a thickness of a normal shell of a normal USB plug compliant with the USB standard.

2. The USB receptacle as recited in claim 1, wherein:

the USB receptacle is selectively mateable with one of the normal USB plug and a custom USB plug;

the USB plug is the custom USB plug;

the custom USB plug includes, as the plug shell, a custom shell which is, at least in part, longer than the normal shell in the mating direction; and the first contact portion and the second contact portion are arranged at positions which the normal shell does not reach when the USB receptacle is mated with the normal USB plug but which the custom shell reaches when the USB receptacle is mated with the custom USB plug.

3. The USB receptacle as recited in claim 1, wherein the first contact portion and the second contact portion face each other in the perpendicular direction.

4. The USB receptacle as recited in claim 1, wherein the perpendicular direction is the pitch direction.

5. The USB receptacle as recited in claim 1, wherein "(b−a)" of the inequality has a positive value.

6. The USB receptacle as recited in claim 1, wherein the detection pin includes a coupling portion which couples the first support portion and the second support portion with each other.

7. The USB receptacle as recited in claim 6, wherein:

the detection pin further includes a base portion which extends from the first support portion; and the base portion is provided with a held portion which is held by the holder member.

8. The USB receptacle as recited in claim 1, wherein:

under an unmated state where the USB receptacle is not mated with the USB plug, the first contact portion is located within the shell; and the shell is formed with an opening which allows a movement of the second contact portion in the predetermined plane.

9. The USB receptacle as recited in claim 1, wherein:

the detection pin further includes a first guide portion and a second guide portion;

the first guide portion extends from the first contact portion and intersects the mating direction;

the second guide portion extends from the second contact portion and intersects the mating direction;

the holder member is provided with an inner guide portion;

the shell is provided with an outer guide portion which is positioned outside of the inner guide portion in the perpendicular direction;

an end of the first guide portion is positioned inside of the inner guide portion in the perpendicular direction;

the first contact portion and the second contact portion are positioned between the outer guide portion and the inner guide portion in the perpendicular direction; and an end of the second guide portion is positioned outside of the outer guide portion in the perpendicular direction.

* * * * *